US006327825B1

(12) United States Patent
Sanders et al.

(10) Patent No.: US 6,327,825 B1
(45) Date of Patent: Dec. 11, 2001

(54) METHOD AND APPARATUS FOR USE IN POSITIONING HIGH-STRENGTH CABLES WITHIN A PRECAST MOMENT RESISTING FRAME

(75) Inventors: Joseph C. Sanders, Pasadena; Albert W. Fink, Visalia; Brian J. Liske, Lemoore, all of CA (US)

(73) Assignee: Charles Pankow Builders Ltd., Altadena, CA (US)

( * ) Notice: Subject to any disclaimer, the term of this patent is extended or adjusted under 35 U.S.C. 154(b) by 0 days.

(21) Appl. No.: 09/557,500

(22) Filed: Apr. 24, 2000

(51) Int. Cl.[7] ..... E04B 1/98
(52) U.S. Cl. ..... 52/167.1; 52/223.14; 52/223.8
(58) Field of Search ..... 52/167.1, 721.1, 52/724.2, 600, 260, 742.16, 259, 223.1, 223.4, 223.5, 223.8, 223.9, 223.14

(56) References Cited

U.S. PATENT DOCUMENTS 3,289,379 * 12/1966 Watts ..... 52/689
4,505,081 * 3/1985 Dinis et al. ..... 52/223 L

* cited by examiner

*Primary Examiner*—Carl D. Friedman
*Assistant Examiner*—U. Slack
(74) *Attorney, Agent, or Firm*—James E. Brunton

(57) ABSTRACT

A method and apparatus for positioning steel reinforcing rods within a precast, moment-resisting frame of a building. The apparatus includes a uniquely configured hand-receiving component that can be embedded within the concrete beams that make up the building frame to permit access to the steel reinforcing rods that are slidably carried within rod receiving passageways formed within concrete beams. The apparatus also includes a uniquely configured-bladder receiving component that can be embedded within the concrete beams that make up the building frame and is so constructed and arranged as to permit as expanable bladder to readily be positioned within the cable receiving passageways formed in the beam during the grouting of the interfaces between the beams and the columns.

20 Claims, 7 Drawing Sheets

METHOD AND APPARATUS FOR USE IN POSITIONING HIGH-STRENGTH CABLES WITHIN A PRECAST MOMENT RESISTING FRAME

BACKGROUND OF THE INVENTION

1. Field of the Invention

The present invention relates generally to a method and apparatus for use in the construction of precast, moment resisting frames of buildings. More particularly the invention concerns a method and apparatus for use in positioning high-strength cables within a precast, moment resisting frame made up of columns and beams that are interconnected by the high-strength cables.

2. Discussion of the Prior Art

In recent years great strides have been made in the design of high rise buildings that resist lateral forces as well as vertical or gravity forces. Lateral or horizontal forces are normally imposed on a building or structure by either wind forces or seismic forces applied to the building. Of particular concern in earthquake-prone areas are seismic forces, and great strides have been made in these areas in the design of seismic-resistant structures. However, experience has shown that even relatively new seismic-resistant, steel-frame buildings have serious shortcomings. For example, building codes are typically written with personal safety in mind and generally require that certain structural members bend to absorb the force of a serious quake and, in this way, spare the occupants of the building. However, following the earthquake, buildings constructed to these codes, while preserving human life may, nevertheless require major repairs, and, in some cases the entire building must be demolished because of the structural damage suffered.

One of the most successful prior art moment resisting frame designs is the design developed by the assignee of the present invention. This novel design concerns precast moment resisting frames made up of columns and beams that are tied together in the horizontal direction by high-strength cables. These cables are entrained through a passageway located in the center of the beam so as to pass through the columns at the same elevation as the beam. In these structures, after the beam and column elements are erected, the cables are entrained through the passageways and stretched or pretensioned. The stretched cables are clamped at the face of the columns resulting in the horizontal force that securely ties the columns and beams together. In some moment frames the horizontal ducts carried within the beams may contain as many as twenty, 0.6-inch-diameter, high-strength cables with a post tensioned force of on the order of 35,000 pounds each. Accordingly, the resulting force acting on the column from the two perpendicular forces transferred to the column may well exceed four hundred tons.

In addition to the high strength cables, the columns and beams of this novel frame design are connected together with reinforcing steel that absorbs energy during lateral movement of the frame. More particularly, at every location where a beam meets a column, short bars or rods, are strategically located above and below the central cable, help secure the joint. Made of stretchy or "mild" steel, the rods uniquely serve to effectively dampen the earthquake's effects.

In an earthquake that causes the building to shake and the vertical columns to sway, the central steel cable of the aforementioned prior art designs will stretch safely and rebound slightly without permitting the beam-to-column joints to shift out of alignment. The mild-steel bars, because of their placement above and below the central cable at each joint, take the brunt of the sideways forces, stretching and retracting much like very large shock absorbers. When the earthquake ends, the frame snaps back to its original shape without major structural damage having occurred.

In the aforementioned types of prior art structures, tension in the stressed cables is typically transferred to the columns through wedge type anchors. The anchor imposes a clamping force on the columns transferring it through the interface between the columns and beam. This creates a compressive force through the moment resisting frame. However, where two perpendicular moment frames intersect at a corner, the bundles of cables from both of the perpendicular beams interfere with each other at the corner column.

A significant problem recognized in the prior art construction concerns the interference of the cables at the corner condition where the five-inch diameter passageways intersect. As will be better appreciated from the discussion which follows, the novel corner transfer, or corner sweep component of the present invention uniquely solves this difficult prior art problem and is specially designed to transfer the forces from the cables into a quarter circle pipe that comprises a part of the corner sweep assembly. The corner sweep assembly uniquely allows the cables to be continued from one moment frame to an adjacent, perpendicularly extending moment frame with the resultant forces being effectively transferred into the interior of the column.

With the novel construction described in the preceding paragraphs, the lower floors of the building can be finished and occupied at a stage when steel structures are still being fitted out with floors and interiors. This makes large areas of the concrete building useful three or four months sooner than portions of a comparable steel frame structure would be.

SUMMARY OF THE INVENTION

It is an object of the present invention to provide an apparatus for transferring forces in tensioned cables from two beams of precast, moment-resisting frame of a building that are perpendicular to each other into a corner column of the frame from which the beams extend. More particularly, the apparatus of the invention comprises a uniquely configured corner transfer, or corner sweep component, that is disposed within the corner column through which the cables are routed.

Another object of the invention is to provide an apparatus of the aforementioned character in which the corner sweep is so constructed and arranged to permit the tensioned cables to be continued from one moment frame to an adjacent perpendicularly extending frame with the result that forces being effectively transferred to the interior of the column.

Another object of the invention is to provide an apparatus for grouting the interface between the concrete beams and the concrete columns that make up the building frame. In this regard, it is a specific object of the invention to provide a uniquely configured bladder-receiving component that can be embedded within the concrete beams that make up the building frame which is so constructed and arranged as to permit an expandable bladder to readily be positioned within the cable-receiving passageways formed in the beam in a manner such that the expandable bladder spans the interface between the beam and the column.

Another object of the invention is to provide a grouting apparatus of the character described in the preceding paragraph in which the expandable bladder, when in position within the cable receiving passageway, can be expanded into sealable engagement with the walls of the cable-receiving passageway and then can be deflated and expeditiously removed from the structure via the bladder receiving component.

These and other objects of the invention will become apparent from the description, which follows.

DISCUSSION OF THE INVENTION

Figure 1:
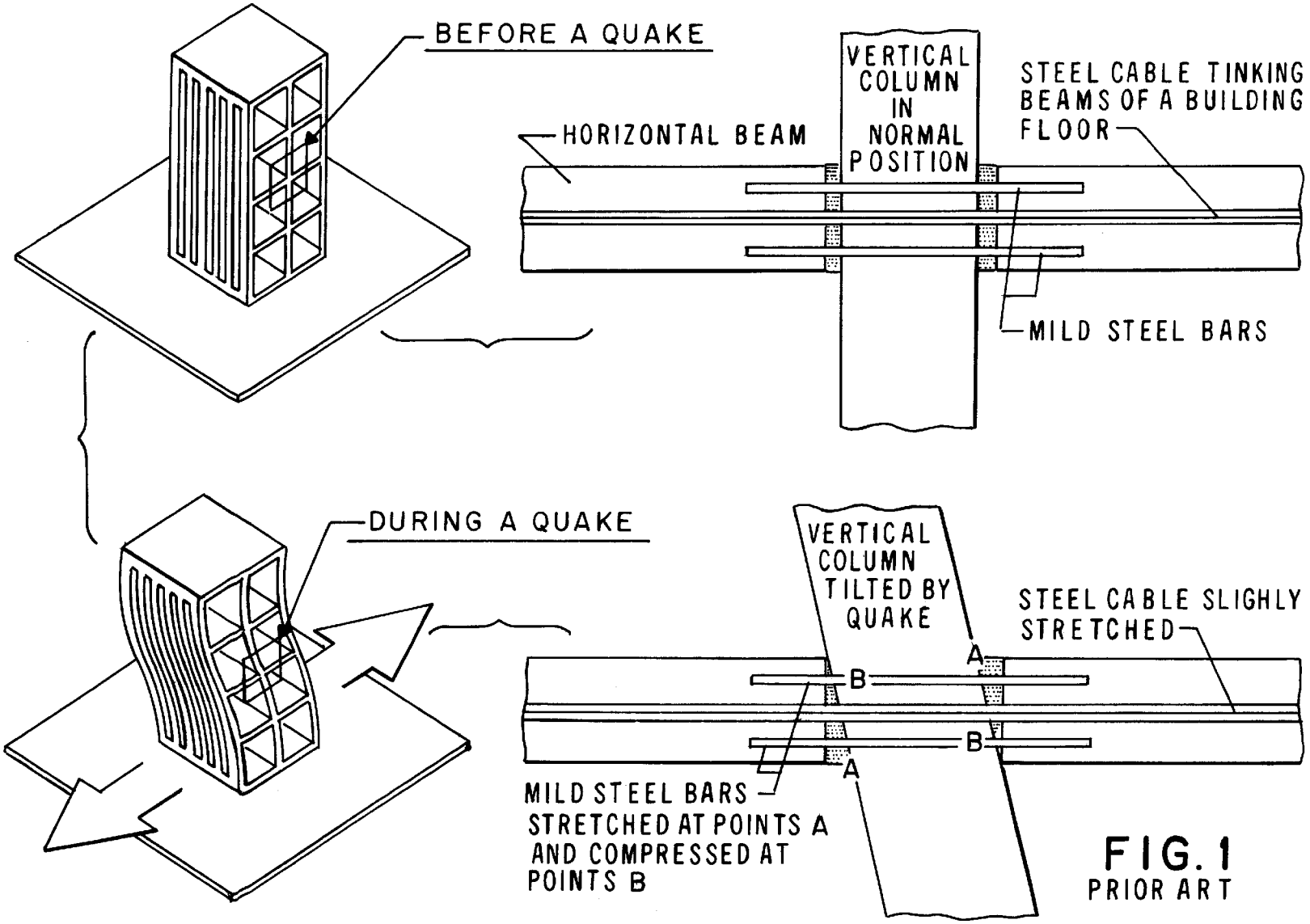
FIG. 1 PRIOR ART
FIG. 1 is a generally diagrammatic view of a prior art, pre-cast, moment-resisting frame-type construction with which the apparatus of the present invention is used.

Referring to the drawings and particularly to FIG. 1, one form of the prior art building construction with which the apparatus of the present invention is usable is there illustrated. This novel building design comprises pre-cast, moment-resisting frames made up of columns and beams that are tied together in a horizontal direction by high-strength cables that are entrained through a passageway located in the center of the beams in the manner shown in FIG. 1. The passageway is located in the center of the beam so as to pass through the columns at the same elevation as the beams in the manner illustrated in the upper right-hand portion of FIG. 1. After the beam and column elements are erected in the manner shown in the upper left-hand corner of FIG. 1, the cables are installed in the ductwork and appropriately tensioned. The tensioned cables are clamped at the base of the columns resulting in the horizontal force that securely ties the columns and beams together.

As shown in the right-hand portion of FIG. 1, in addition to the high strength cables used in the prior art frame design, the beams of the design are connected together with mild-steel reinforcing bars that absorb energy during lateral movement of the frame as illustrated in the lower portion of FIG. 1. At every location where a beam meets a column, short bars, which are located above and below the central cable, help to secure the joints.

In an earthquake that causes the building to shake and the vertical columns sway in the manner illustrated in the lower left-hand portion of FIG. 1, the central steel cable of the frame construction will stretch and rebound slightly without permitting the beam to column joints to shift out of alignment. As illustrated in the lower right-hand portion of FIG. 1, the mild-steel bars will be stretched at point A and will be compressed at point B, stretching and retracting much like very large shock absorbers. When the earthquake ends, the frame snaps back into its original shape as shown in the upper left-hand portion of FIG. 1 without major structural damage having occurred.

In the prior art structure of the character illustrated in FIG. 1, tension in the stressed cables is typically transferred to the column through wedge type anchors that impose a clamping force on the columns transferring it through the interface between the columns and beams thereby creating a compressive force through the moment-resisting frames. However, as previously mentioned, where to two perpendicular moment frames intersect at a corner, the bundles of cables from both of the particular beams interfere with each other at the corner columns. It is this problem that one form of the apparatus of the present invention seeks to overcome.

Figure 2:
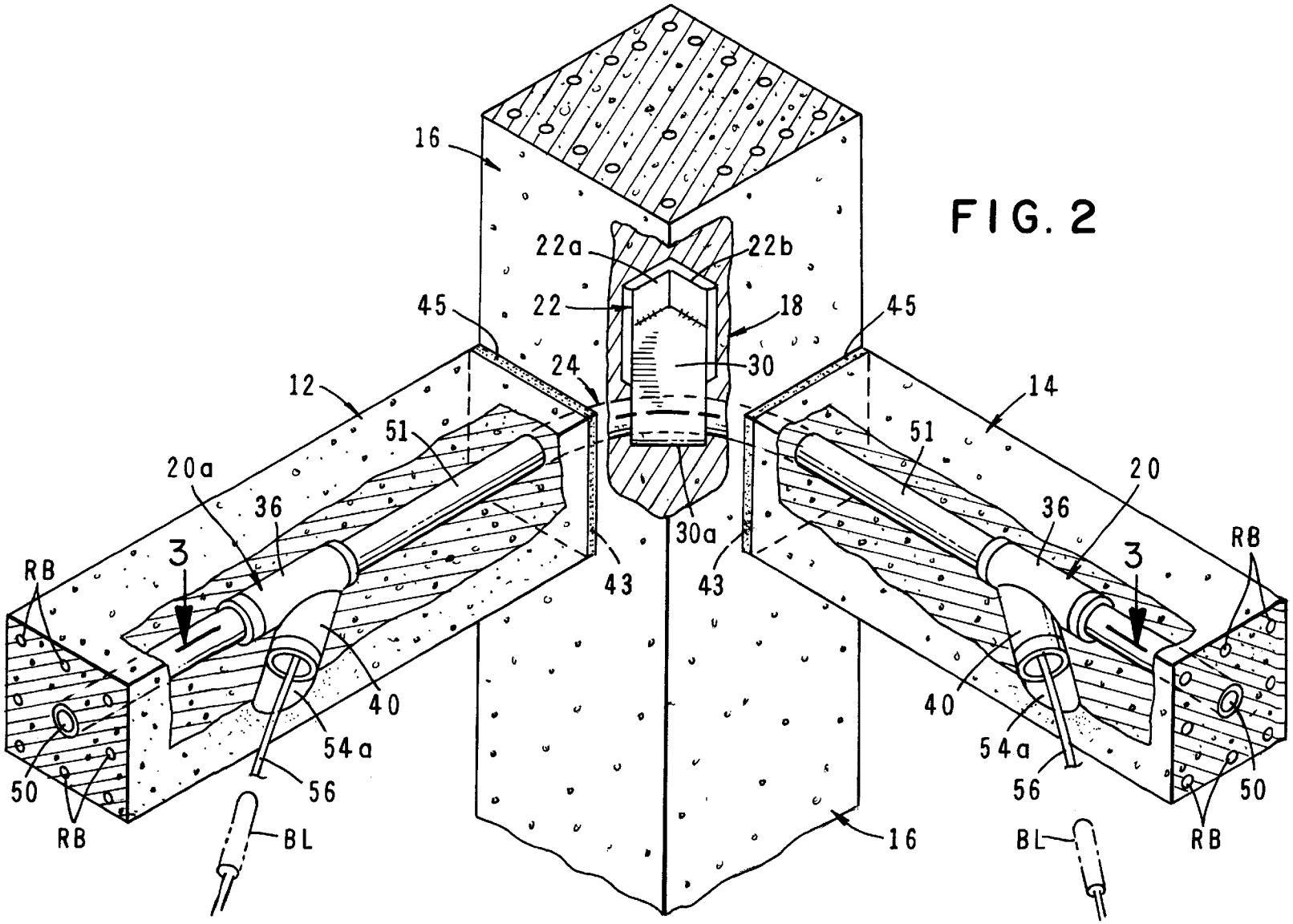
FIG. 2 is a generally perspective, fragmentary view showing one form of the apparatus of the present invention installed within one corner of the prior art frame construction illustrated in FIG. 1.
Figures 2A, 3:
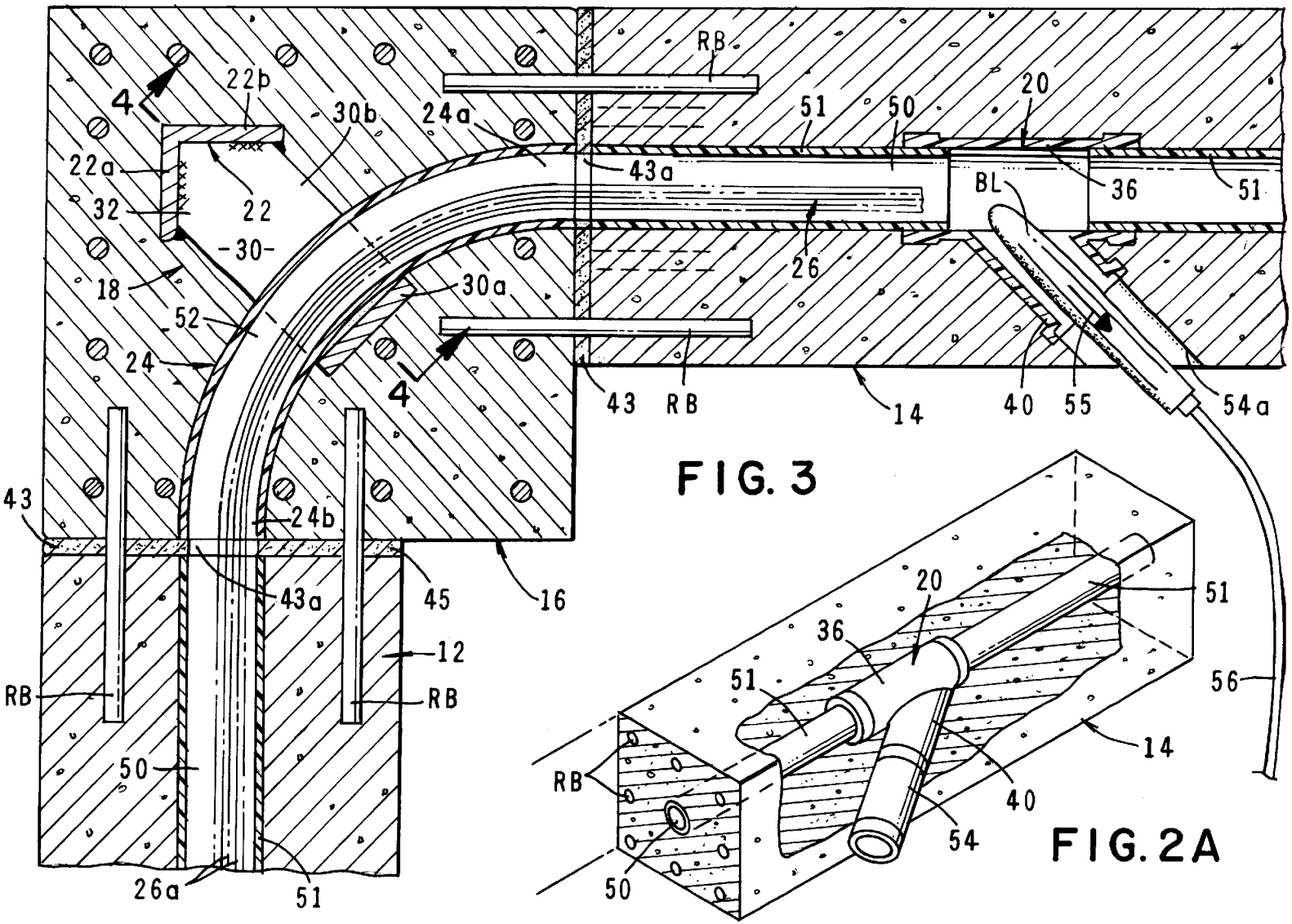
FIG. 2A is a generally perspective, fragmentary view illustrating the casting of one of the beams of the frame in a manner to form an access opening that communicates with the bladder positioning component.
FIG. 3 is a greatly enlarged, cross-sectional view taken along lines 3—3 of FIG. 2.

Referring next to FIGS. 2 and 3, one embodiment of the apparatus of the invention for transforming forces in the tensioned cables from two beams 12 and 14 that are perpendicular to each other into a corner beam 16 from which the beams extend. The apparatus of the present form of the invention comprises two major assemblies, namely an anchor assembly generally designated in FIG. 2 by the numeral 18 and an access means comprising a pair of generally Y-shaped access members 20 and 20*a* which accept expandable bladders that permit grouting of the interfaces between the column and beams in a manner to keep the cable passageways open. The details of the construction and use of access members 20 and 20*a* will presently be described.

Figure 6:
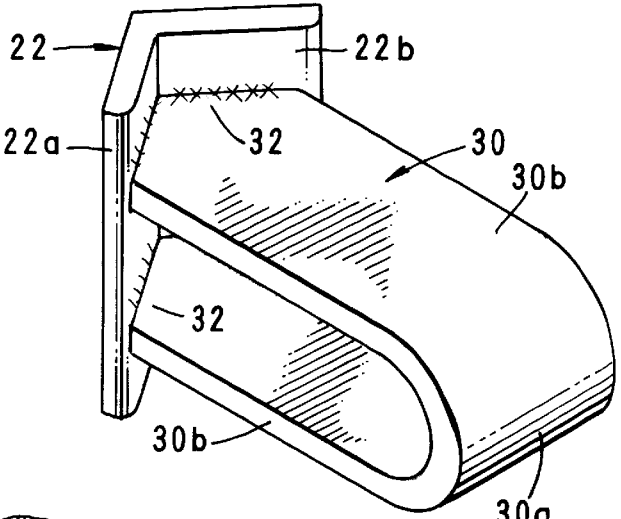
FIG. 6 is a generally perspective view of one form of the anchor assembly of the present invention.
Figure 5:
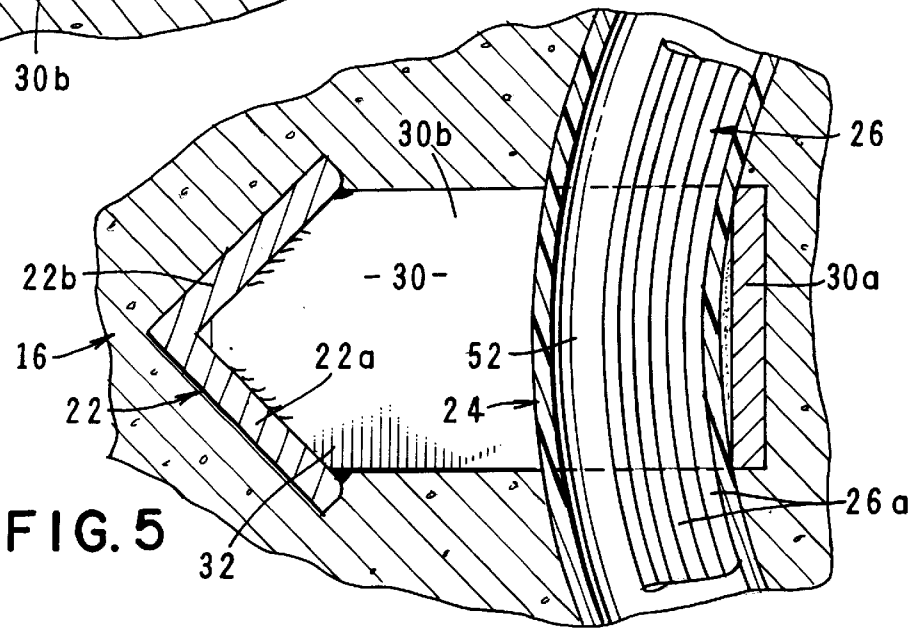
FIG. 5 is a cross-sectional view taken along lines 5—5 of FIG. 4.
Figure 4:
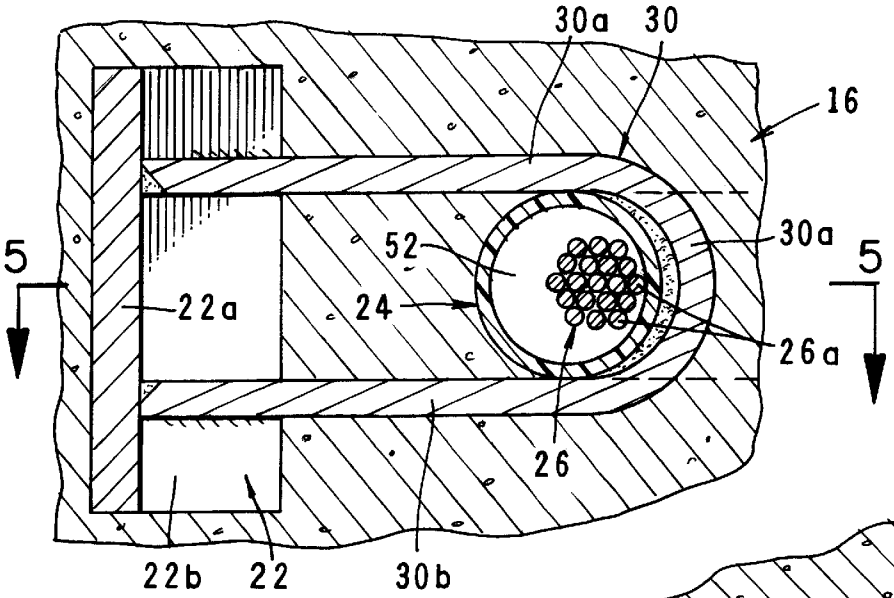
FIG. 4 is a greatly enlarged, cross-sectional view taken along lines 4—4 of FIG. 3.

Considering first the novel anchor assembly of the invention, this assembly as shown in FIGS. 4, 5, and 6 comprises an anchor member 22 that is fixedly mounted within corner column 16 in the manner shown in FIG. 3. Anchor member 22 comprises a part of the anchor means of the invention and here comprises an angle bracket having first and second, generally perpendicularly extending legs 22*a* and 22*b*. Also forming a part of the anchor assembly is a cable routing means which is disposed within the corner column proximate the anchor member. As best seen in FIGS. 3, 4, and 5, this cable routing means here comprises a quarter circle, curved tubular member 24. Member 24 has first and second open ends 24*a* and 24*b* that are substantially flush with the faces of the columns. Tubular member 24 uniquely functions to route the bundle of cables 26 through the column 16 in the manner illustrated in FIGS. 3, 4 and 5.

Tubular member 24 is interconnected with anchor member 22 by connector means that also comprises a part of the anchor means of the invention and here comprises a strap-like member 30 which is of the configuration best seen in FIG. 6. More particularly, strap-like member 30 is generally U-shaped in cross section and comprises a byte portion 30*a* and spaced-apart sides 30*b* that are integrally formed with byte portion 30*a*. As indicated in FIG. 6, each of the sides 30*b* is provided with an angled end portion 32 that is securely affixed to angle bracket 22 in any suitable means such as by welding. As illustrated in FIGS. 3 and 4, tubular member 24 passes through strap-like member 30 so that the tubular member is in close proximity with byte portion 30*a* of the connector means.

With the anchor assembly of the invention fixedly positioned within column 16 in the manner shown in FIG. 3, the cables 26*a* which make up cable bundle 26 can be smoothly continued from one moment frame to an adjacent perpendicularly extending moment frame with the resultant forces being effectively transferred to the interior of the column 16.

Considering next, the novel access means of the invention for accessing the interior of tubular member 24, this novel means here comprises the previously mentioned first and second generally Y-shaped members 20 and 20*a* respectively. Members 20 and 20*a* are of identical construction with each having a generally horizontally extending leg 36 and an angularly outwardly extending leg 40 that is integrally formed with horizontally extending leg 36.

Figure 7:
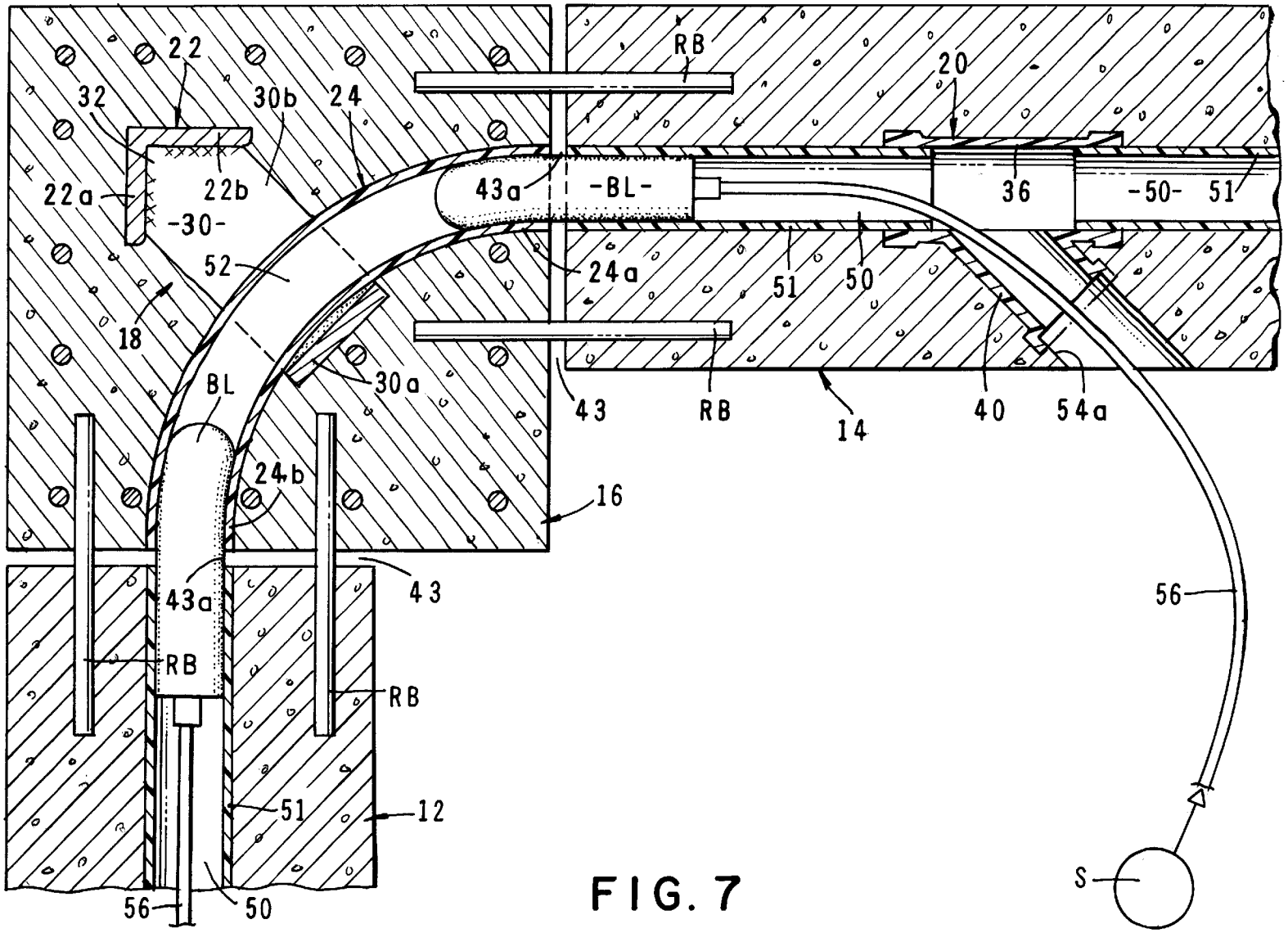
FIG. 7 is a cross-sectional view similar to FIG. 3, but showing the structure prior to grouting the interfaces between the column and the beams and showing a pair of expandable, grout-blocking bladders in position across the interfaces between the beams and the column.

Referring particularly to FIG. 7, it should be noted that when the beams 12 and 14 are correctly positioned relative to column 16, the ends of each of the beams is spaced apart from the face of the column 16 so as to define an interface or space 43. As shown in FIG. 2, in the finished construction, this interface 43 is substantially filled with a grout material 45. However, during the grouting step, it is important that the portion 43*a* of each of the interfaces that abut with the central passageways 50 of the beams and the central passageway 52 of curved tubular member 24 remain free of grout (FIG. 3) to permit free passage of the steel cables therethrough. Passageways 50 are here defined by lengths of thin wall plastic tubing 51 which are connected to members 20 and 20*a*.

As illustrated in FIG. 7, to prevent intrusion of grout into portions 43*a* of the interfaces 43, expandable bladders BL are inserted into passageways 50 of each of the beams and are then advanced to the position shown in FIG. 7 where the bladders span the interface portions 43*a*. Expandable or inflatable bladders BL are of a character well known to those skilled in the art and are readily commercially available from sources such as Cherne Industries Incorporated of Minneapolis, Minn.

The previously identified access means of the present invention performs the important function of permitting the insertion of bladders BL into central passageways 50 of the beams so that they can be advanced across interface portions 43*a* of interfaces 43 and into the central passageway 24*a* of curved tubular member 24. This step is accomplished by inserting each of the bladders BL in a deflated condition as shown in FIGS. 3 and 3A into a selected one of the angularly extending legs 40 of the access means via an opening 54*a* that is formed during the casting process by an extension member 54 that is affixed to leg 40 in the manner shown in FIG. 2A. After openings 54*a* are formed, extension members 54, which are used only during the casting process, are removed. With the bladders BL deflated, it is a simple matter to insert the bladders into the central passageway 50 of each of the beams and to easily advance the bladders to the position shown in FIG. 7 where they span interface portions 43*a*. With the bladders in this position, they can be inflated using an elongated air hose 56 which is attached to each of the bladders BL and extends outwardly therefrom through passageways 50, through the access means, and to the exterior of the beams via the openings 54*a* where the air hose can be attached to a suitable source of air under pressure, such as that identified in FIG. 7 as "S". With the mild steel reinforcing bars RB in position, the bladders BL can be inflated in the manner shown in FIG. 7 and the grouting step can commence. The grouting step can be accomplished in any suitable manner well known to those skilled in the art to seal the interfaces with grout in the manner shown in FIG. 2. Once the interfaces have been filled with grout and the grout has set up, the bladders BL can be deflated and removed from the access means in the manner indicated by the arrows 55 in FIGS. 3, and 3A.

Figure 3B:
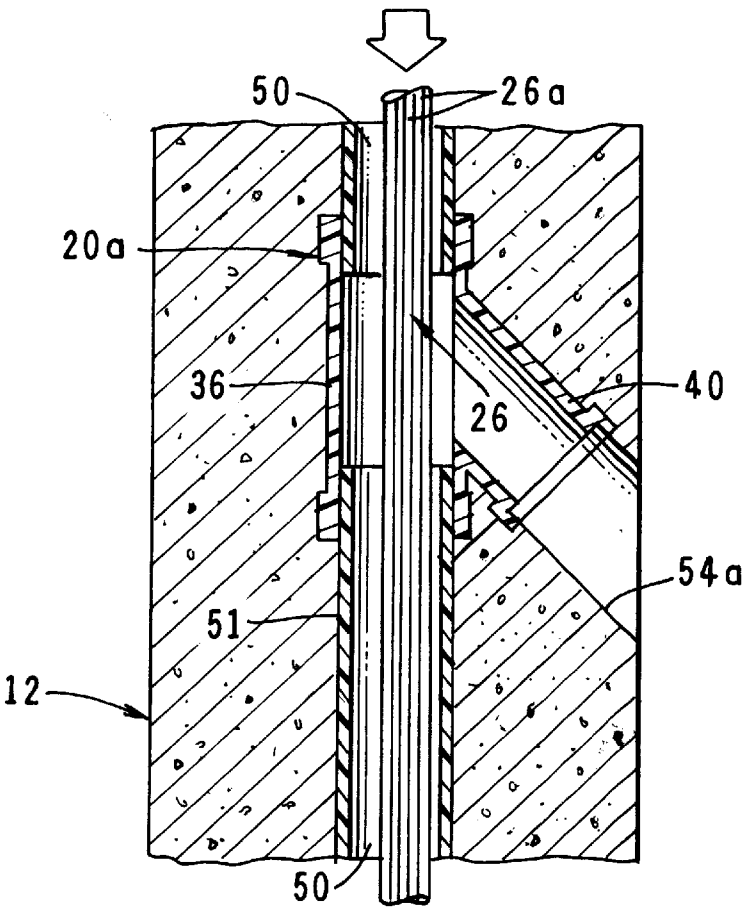
FIG. 3B is a fragmentary, cross-sectional view similar to FIG. 3A, but showing the tensioned cables in position within the central passageway of the beam.
Figure 3A:
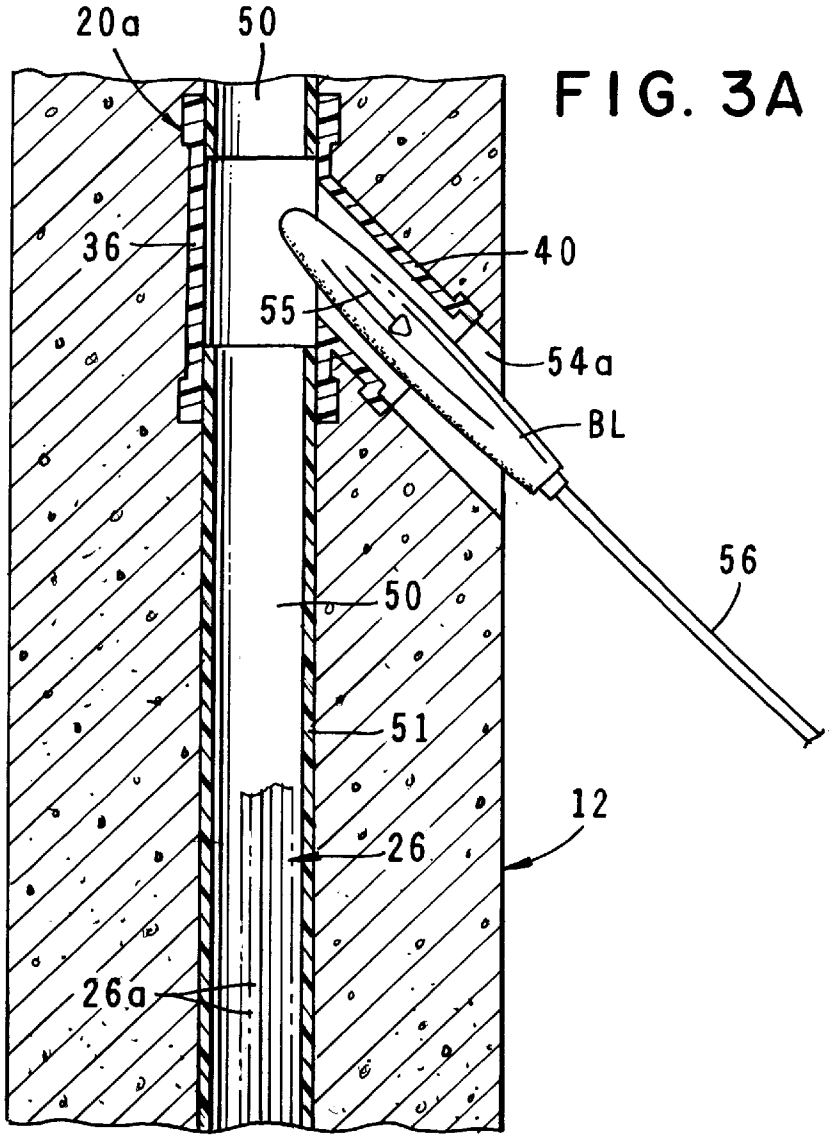
FIG. 3A is a cross-sectional, fragmentary view illustrating the continuance of the beam shown in the left portion of FIG. 3.
Figure 8:
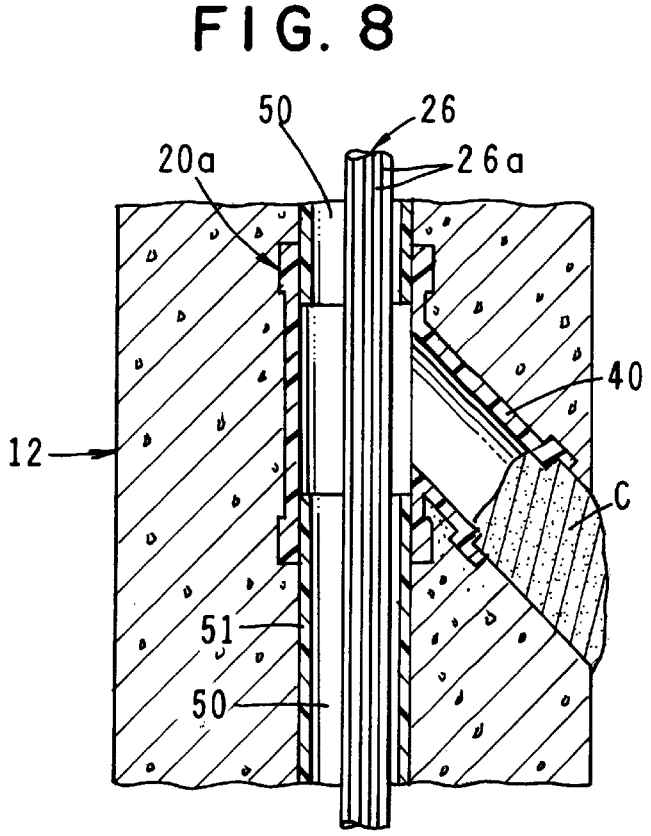
FIG. 8 is a fragmentary, cross-sectional view of a portion of one of the beams of FIG. 7 illustrating the plugged of the access opening of one of the beams.
Figure 7A:
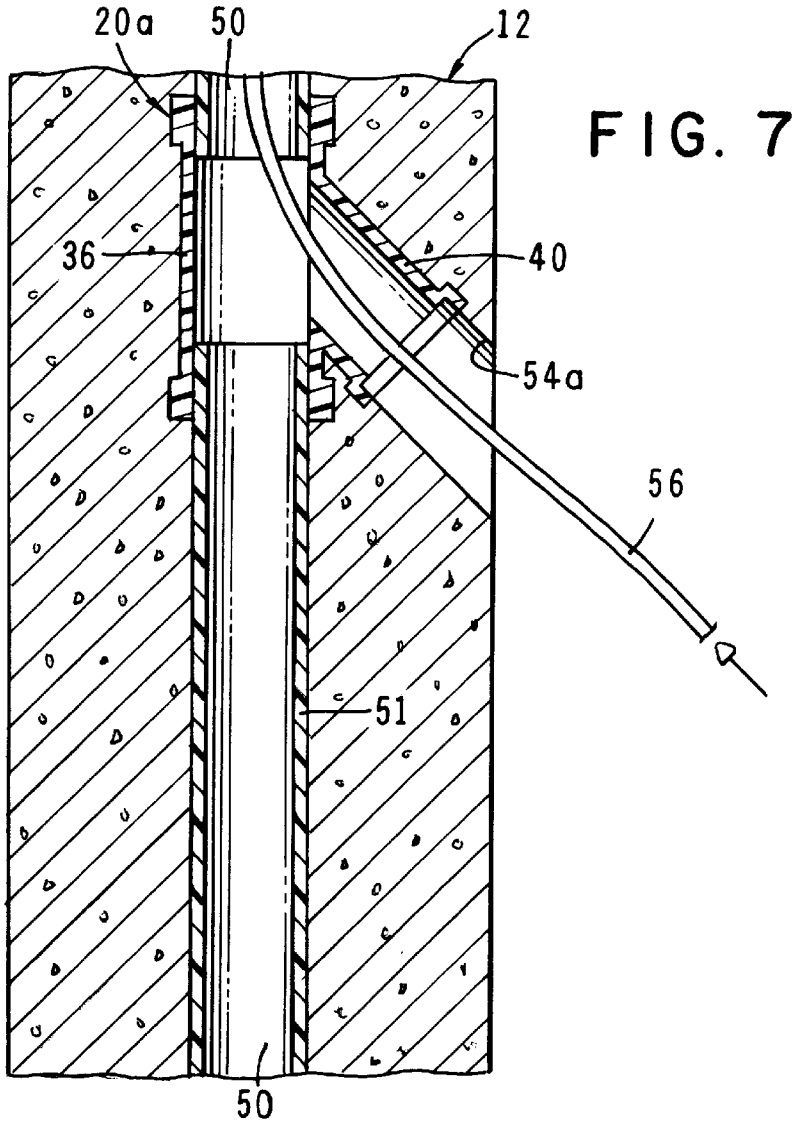
FIG. 7A is a fragmentary, cross-sectional view illustrating the continuance of the beam shown in the left-hand portion of FIG. 7.

As indicated in FIG. 3B, once the grouting of interfaces 43 has been completed and the bladders BL removed from the beams, the cables 26*a* can be entrained through the cable-receiving passageways of the structure. Following the routing of the cables through the cable passageways, openings 54*a* are filled with concrete "C" so as to seal the cavity in the manner shown in FIG. 8.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. In combination with first and second beams that are generally perpendicular to each other and a corner column from which the beams extend, an apparatus for transferring forces in tensioned, adjacently disposed, continuous cables extending through the first and second beams and through the corner column against which the beams abut, said apparatus comprising:

(a) cable routing means comprising a quarter circle tubular member disposed within the corner column for routing the cables through the corner column, said tubular member terminating at one end proximate the juncture of the first beam and the corner column and terminating at the other end proximate the juncture of the second beam and the corner column; and (b) anchor means for anchoring said cable routing means within the corner column.

2. The apparatus as defined in claim 1 further including access means disposed within at least one of the two beams for accessing said cable routing means.

3. The apparatus as defined in claim 1 in which said anchor means comprises an anchor member fixedly mounted within the corner column and connector means disposed within the corner column for interconnecting said anchor member with said cable routing means.

4. The apparatus as defined in claim 3 in which said anchor member comprises an angle bracket having first. and second generally perpendicularly extending legs.

5. The apparatus as defined in claim 3 in which said cable routing means comprises a quarter circular steel pipe for receiving the cables.

6. In combination with first and second beams that are generally perpendicular to each other and a corner column against which the beams abut, an apparatus for transferring forces in continuous, tensioned cables extending through the first and second beams and through the corner column from which the beams extend comprising:

(a) an anchor member fixedly mounted within the corner column;

(b) cable routing means disposed within the corner column proximate said anchor member for routing the cables through the corner column; and (c) connector means disposed within the column for interconnecting said cable routing means with said anchor member.

7. The apparatus as defined in claim 6 further including access means disposed within at least one of the two beams for accessing said cable routing means.

8. The apparatus as defined in claim 6 in which said anchor means comprises an angle bracket having first and second generally perpendicular extending legs.

9. The apparatus as defined in claim 6 in which said cable routing means comprises a curved tubular member for receiving the cables.

10. The apparatus as defined in claim 6 in which said connector means comprises a connector strap that is generally U-shaped in cross section and includes a bight portion and two spaced-apart sides connected to said bight portion, each of said sides having an end portion connected to said angle bracket.

11. The apparatus as defined in claim 6 in which said access means comprises a generally Y-shaped tubular member fixedly mounted within at least one of the two beams.

12. The apparatus as defined in claim 11 in which said generally Y-shaped member comprises a generally horizontally extending tubular portion within which the cables are received and an angularly extending tubular portion accessible from the exterior of the beam.

13. In combination with two beams that are generally perpendicular to each other and a corner column, an apparatus for transferring forces in tensioned cables from the two beams into the corner column from which the beams extend, comprising:

(a) an angle bracket having first and second, generally perpendicularly extending legs;

(b) a connector strap that is generally U-shaped in cross section comprising a bight portion and two spaced apart sides connected to said bight portion, each of said sides having an end portion connected to said angle bracket;

(c) a curved tubular member for receiving the cables, said curved tubular member extending between said sides of said connector strap and being disposed proximate said bight portion thereof; and (d) access means disposed within each of the beams for accessing the curved tubular member.

14. The apparatus as defined in claim 13 in which said access means comprises a generally Y-shaped member disposed within each of said beams.

15. The apparatus as defined in claim 14 in which said the generally Y-shaped member comprises a generally horizontally extending tubular portion within which the cables are received and an angularly extending tubular portion accessible from the exterior of the beam.

16. In combination with two beams that are generally perpendicular to each other and a corner column, an apparatus for transferring forces in tensioned cables from the two beams into the corner column from which the beams extend, comprising:

(a) an angle bracket having first and second, generally perpendicularly extending legs;

(b) a connector strap that is generally U-shaped in cross section comprising a bight portion and two spaced apart sides connected to said bight portion, each of said sides having an end portion connected to said angle bracket;

(c) a curved tubular member for receiving the cables, said curved tubular member extending between said sides of said connector strap and being disposed proximate said bight portion thereof; and (d) access means disposed within each of the beams for accessing the curved tubular member, said access means comprising a generally Y-shaped member disposed within each of said beams, said generally Y-shaped member comprising a generally horizontally extending tubular portion within which the cables are received and an angularly extending tubular portion accessible from the exterior of the beam.

17. The apparatus as defined in claim 16 in which said access means futher includes an extension removably connected to said angularly extending tubular portion of said Y-shaped member.

18. A method for grouting the interface between a concrete beam and an adjacent concrete column having coaxially aligned cable receiving passageways, said method comprising the steps of:

(a) embedding within the concrete beam a generally Y-shaped component having a tubular body portion aligned with the cable receiving passageway of the beam and an angularly extending portion accessible from the exterior of the beam;

(b) inserting into said angularly extending portion a deflated, expandable bladder;

(c) advancing said deflated bladder with the cable receiving passageway to a location where it spans the interface between the beam and the column;

(d) inflating the bladder to move the bladder into sealable engagement with the cable receiving passageway of the beam and column;

(e) forcing grout into the interface;

(f) deflating the bladder from the beam; and (g) removing the bladder from the beam.

19. The method as defined in claim 18 in which the angularly extending portion of the generally Y-shaped component comprises a first leg connected to the body portion and an extension removably connected to the first leg and in which the method comprises the step of removing the extension from the first leg following removal of the bladder from a cavity within the beam.

20. The method as defined in claim 19 including the further step of filling said cavity.

* * * * *